US010812885B1

(12) United States Patent
Tarlow

(10) Patent No.: US 10,812,885 B1
(45) Date of Patent: Oct. 20, 2020

(54) SOUND EMITTING BOWL

(71) Applicant: Kenneth A. Tarlow, San Rafael, CA (US)

(72) Inventor: Kenneth A. Tarlow, San Rafael, CA (US)

( * ) Notice: Subject to any disclaimer, the term of this patent is extended or adjusted under 35 U.S.C. 154(b) by 0 days.

(21) Appl. No.: 16/125,685

(22) Filed: Sep. 8, 2018

(51) Int. Cl.
*H04R 1/02* (2006.01)
*H04R 3/00* (2006.01)
*A47G 23/00* (2006.01)

(52) U.S. Cl.
CPC ..... *H04R 1/028* (2013.01); *A47G 23/00* (2013.01); *H04R 3/00* (2013.01)

(58) Field of Classification Search
CPC ..... H04R 1/028; H04R 3/00; A47G 23/00
See application file for complete search history.

(56) References Cited

U.S. PATENT DOCUMENTS 7,789,041 B1 * 9/2010 Taylor ..... A01K 5/0114 119/51.01
9,723,812 B2 * 8/2017 Jones ..... F16M 11/041
2016/0088958 A1 * 3/2016 Cignarella ..... A63H 33/26 446/73

OTHER PUBLICATIONS

Wikipedia, Photodetector, https://en.wikipedia.org/wiki/Photodetector (viewed on Feb. 24, 2019 8:02 a.m. ET); Internet Archive, https://web.archive.org/web/20180728083237/https://en.wikipedia.org/wiki/Photodetector, Jul. 28, 2018 (Year: 2018).*
Wikipedia, Photodiode, https://en.wikipedia.org/wiki/Photodiode (viewed on Feb. 24, 2019 8:02 a.m. ET); Internet Archive, https://web.archive.org/web/20180728083237/https://en.wikipedia.org/wiki/Photodetector, Aug. 17, 2018 (Year: 2018).*

* cited by examiner

*Primary Examiner* — Nader Bolourchi

(57) ABSTRACT

A sound emitting bowl assembly capable of holding liquid or solid food where a plurality of light emitting photo diodes and photo sensors are aimed at each other across the top plane of the bowl so that when a spoon breaks the plane of light, a message or melody, that has been pre-recorded and stored below the base of the bowl, automatically plays. Additionally, LED lights located on the outside of the bowl become illuminated as the message or melody is played. The photo diodes, photo sensors and LEDs are mounted on a separate bowl retaining assembly so that the bowl may be removed from the bowl retaining assembly for cleaning purposes and then replaced into the bowl retaining assembly for further use.

3 Claims, 9 Drawing Sheets

SOUND EMITTING BOWL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of food bowls and more specifically to an audio emanating bowl.

Bowls for retaining liquid or solid food items have been in use for thousands of years. Parents with young children sometimes have the problem of encouraging the child to eat the food that is in front of them.

It has been shown that words of encouragement coming from a parent or other meaningful role model such as a sports hero, an action hero or the voice of a famous person can help a young person feel motivated to eat.

In many instances, the parent or other role model may not be readily available to offer words of encouragement to a young eater, and it would therefore be advantageous to provide a special bowl that emits audio sounds that are either custom recorded by the parents, or pre-recorded by a person that the child appreciates, so that when the child dips his or her spoon into the bowl, a recorded sound is emitted from the bowl thereby encouraging the child to continue eating.

BRIEF SUMMARY OF THE INVENTION

The primary object of the invention is to provide a bowl capable of holding liquid and semi-liquid food items that includes an audio sound generating device that is automatically activated when the user's spoon crosses the top plane of the bowl.

Another object of the invention is to provide a sound emitting bowl that includes colored LED lights that can illuminate the exterior of the bowl.

Another object of the invention is to provide a sound emitting bowl where a person can record multiple messages or melodies onto the audio sound generating device and where one message or melody at a time is played by the audio sound generating device each time the user dips his or her spoon into the bowl.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an audio emanating bowl comprising: a bowl capable of holding liquid or solid food, a bowl retaining assembly, a plurality of curved cover panels, an audio circuit, a speaker, a battery power supply, a PC board, a plurality of LEDs, a plurality of photo diodes, a plurality of photo sensors, an on off switch, a record switch, said bowl capable of nesting inside of said bowl retaining assembly, said bowl retaining assembly including a plurality of receiving sockets for said curved cover panels, said curved cover panels each retaining one set electrically conductive wires terminating in and LED and one set of wires terminating in either a photo diode or a photo sensor, said photo diodes each directing a beam of light to a photo sensor located directly across from said photo diode, said PC board, said speaker, said battery power supply and said audio circuit mounted within a cavity at the base of said bowl retaining assembly, said bowl retaining assembly including a base plate, said bowl retaining assembly also including a removable upper panel for access to said battery power supply, said record switch and said on-off switch mounted to the said bowl retaining base plate, said audio circuit including a memory chip that can store a plurality of audio messages or melodies, so that when a user dips his or her spoon into said bowl, said spoon interrupts the plane of light projected by said photo diodes thereby triggering one of the recorded messages or melodies that is played by said audio circuit and said speaker, and said LEDs automatically illuminating as said message or melody is being played.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 10 is a bottom perspective view with the bottom panel removed.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
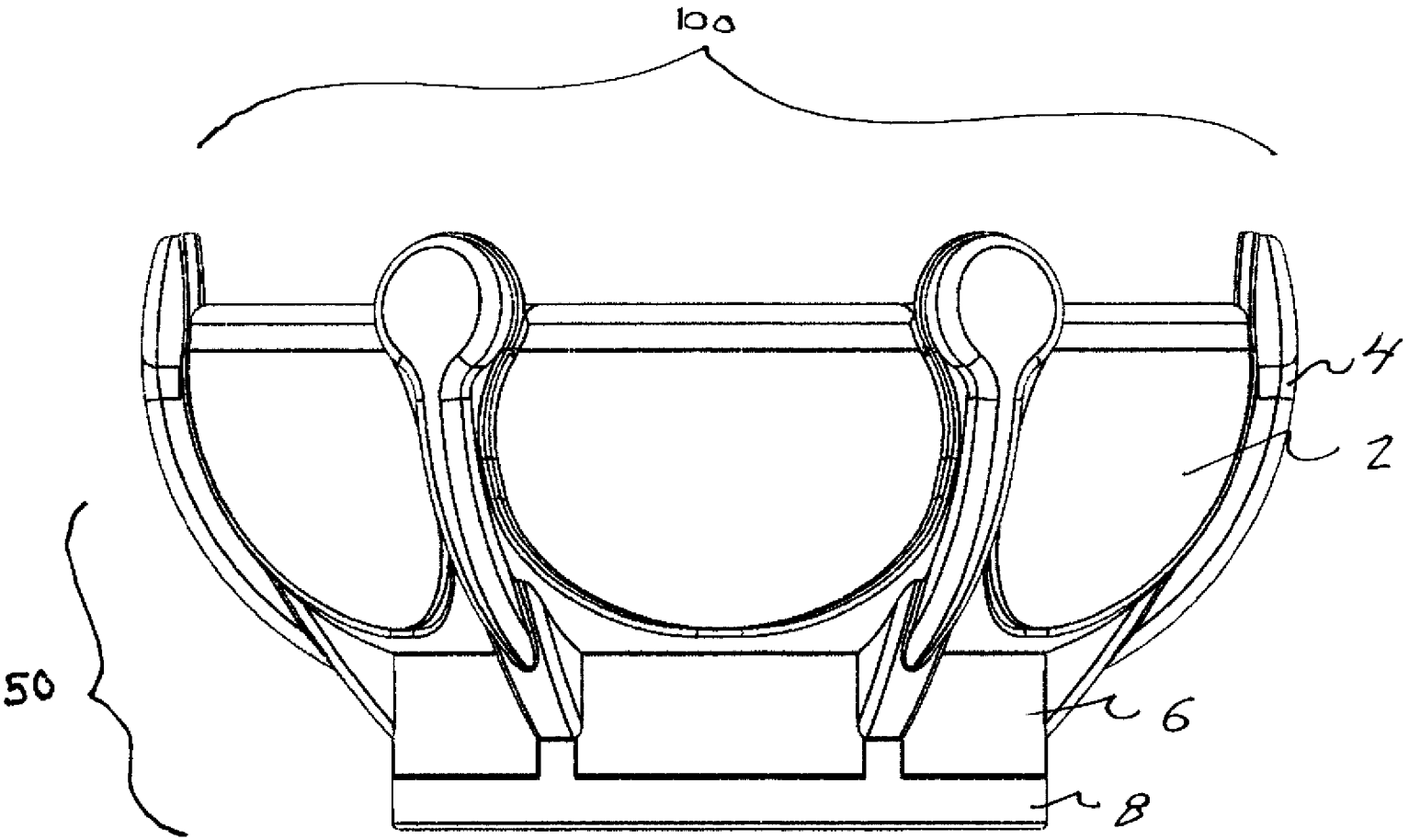
FIG. 1 is a side view of the invention.

Referring now to FIG. 1 we see a side view of the present invention 100. A bowl 2 capable of retaining liquid or solid food items is retained in a bowl assembly 50 that consists of a main body 6, inner fingers 55, a base plate 8, and top plate 20 shown in FIG. 2. A plurality of curved cover plates 4 cover fingers 55.

Figure 2:
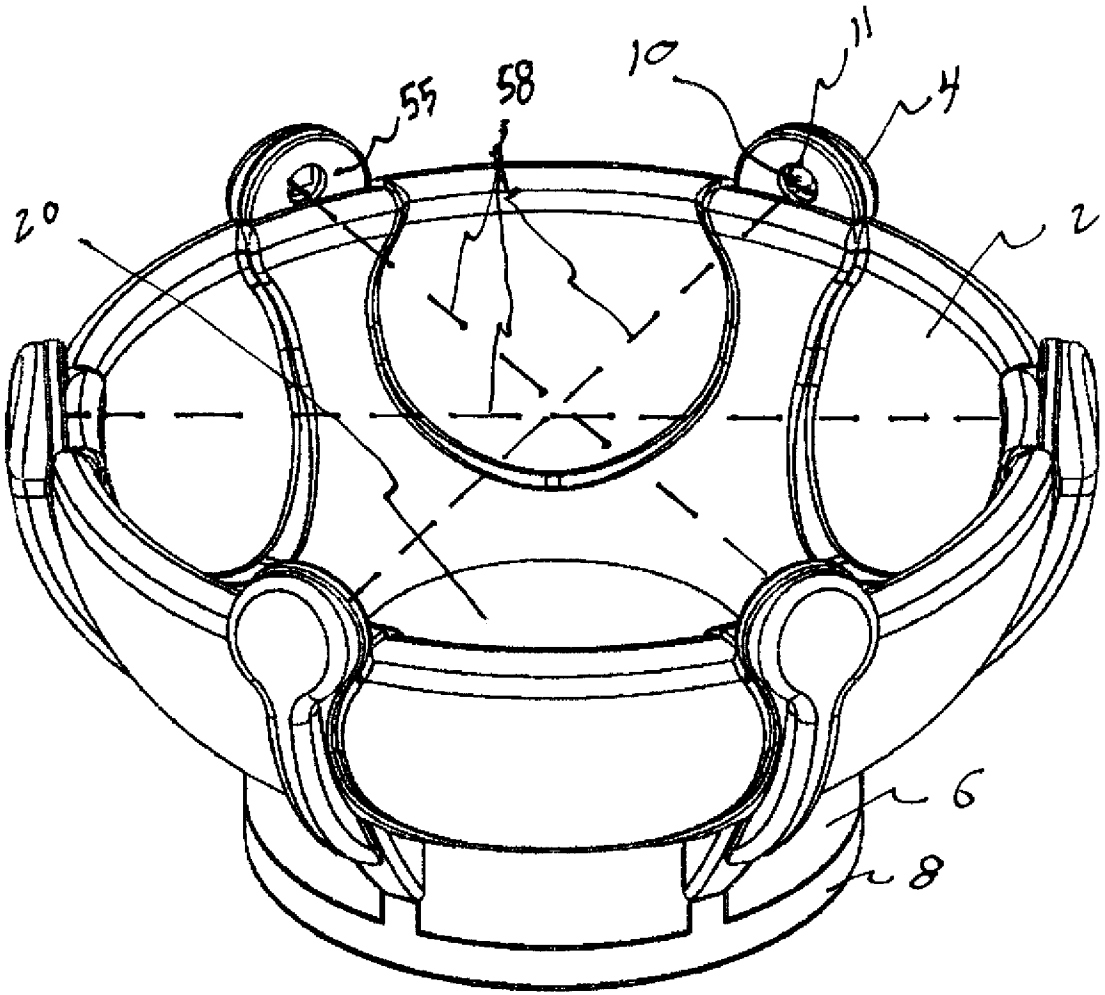
FIG. 2 is a perspective view of the invention.
Figure 3:
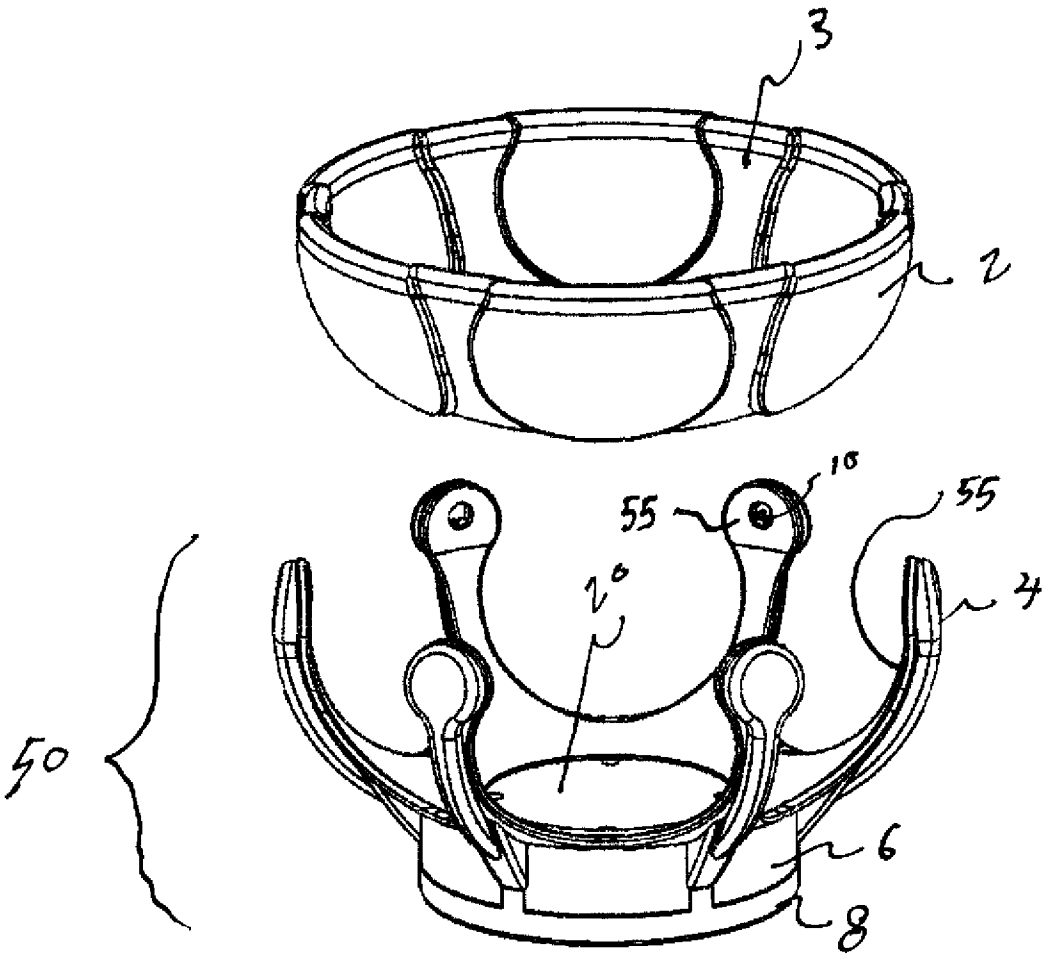
FIG. 3 is an exploded view of the invention

Referring to the perspective view in FIG. 2, each finger 55 includes an aperture 11 that that allows either a photo diode 10 or a photo sensor 12 to be seen. The photo diodes 10 are opposite the photo sensors 12 so that when the photo diode 10 emits a beam of light as shown by dotted line 58, is picked up by the photo sensor 12. If the beam of light is broken, by a person dipping a spoon into the bowl 2, a signal is sent to a microprocessor that includes an audio circuit and digital memory. When the beam is broken, it triggers the playing of an audio message or melody that has been pre-recorded into the digital memory. The message can be custom made by a parent or care giver, or it can be pre-recorded before the bowl is purchased and can include the sound of a famous person or animated character. The fact that the preferred embodiment includes three photo sensors and three photo diodes, the chances of the beam being broken by the spoon are relatively high. Obviously, a greater or lesser number of photo diodes and sensors can be used which will change the likelihood of one of the beams being broken. Any interrupted beam will trigger an audio message or melody. Multiple messages or melodies can be pre-recorded and can be played either randomly or in a fixed sequence.

FIG. 2 is an exploded view of the invention. Bowl 2 is shown as removed from bowl retaining assembly 50 The recessed portions 3 of the bowl 2 allow the fingers 55 of the bowl retainer 50 to nest in place and lock the bowl 2 into the bowl retainer 50.

Figure 4:
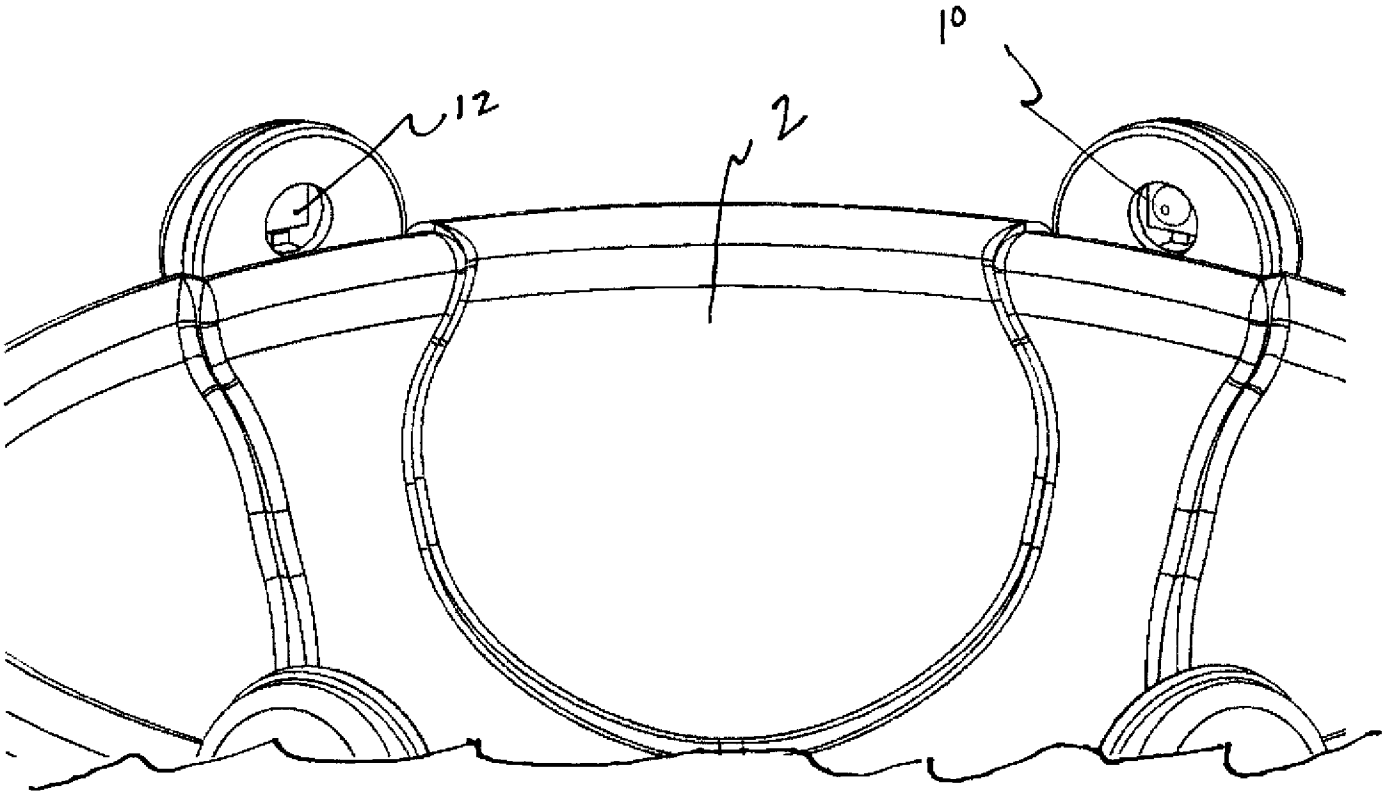
FIG. 4 is a partial perspective view of the invention.

FIG. 4 is an enlarged partial perspective view clearly showing a photo diode 10 and a diode sensor 12 which both are located just above the top perimeter of the bowl 2

Figure 5:
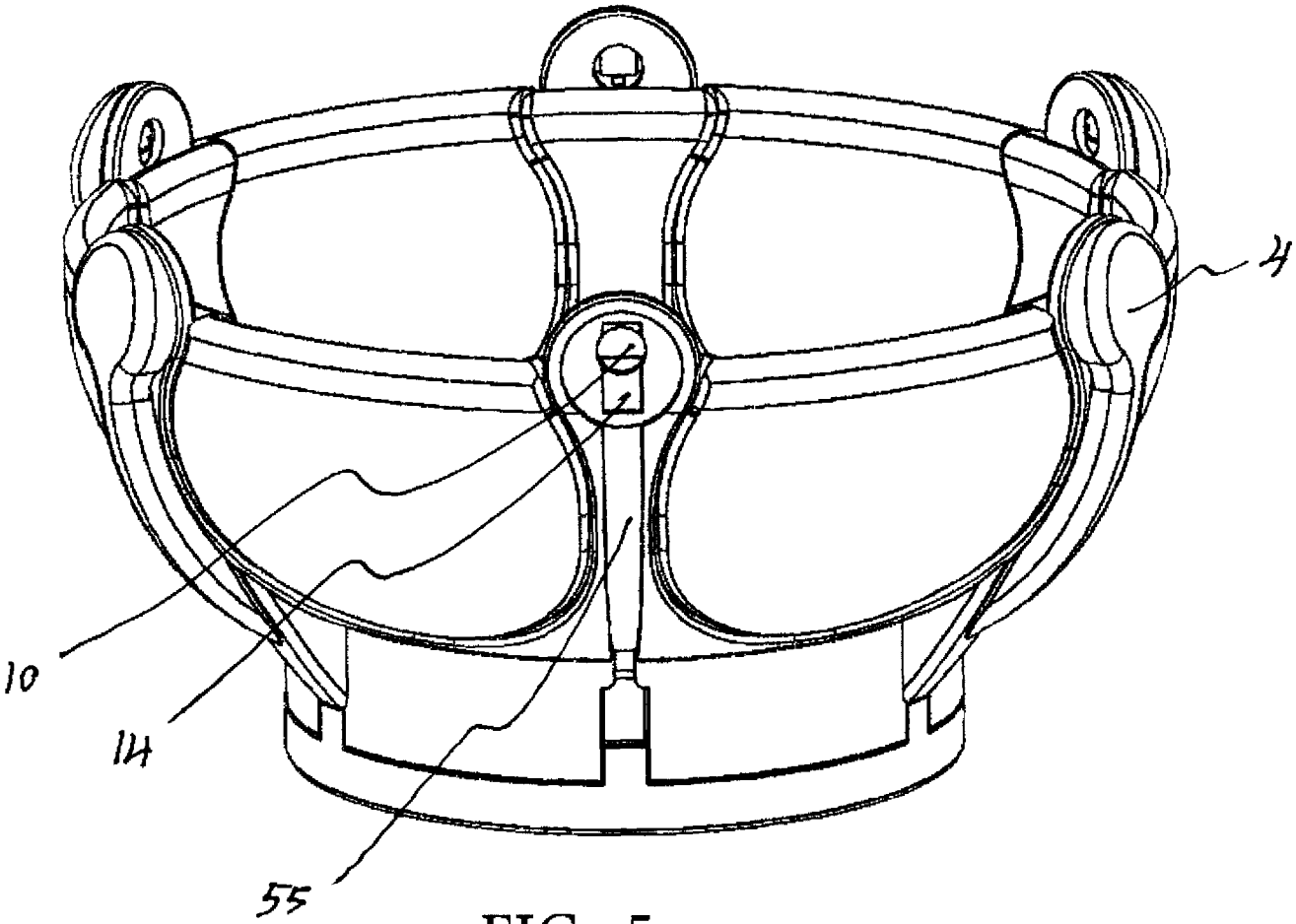
FIG. 5 is a perspective view of the invention with a curved cover panel removed.

FIG. 5 shows a perspective view of the invention with one curved cover plate 4 removed. The interior of the cover plate 4 holds wires that lead from the PC board stored in the base of the bowl retainer assembly 50. One set of wires connects the photo diode 10 or the diode sensor 21 to the PC board 24 shown in the section view in FIG. 9. Another set of wires connects an LED 14 to the PC board 24. The outer curved cover plate 4 is molded from translucent plastic, so that LED 14 can be seen shining out through the cover plate 4.

Figure 6:
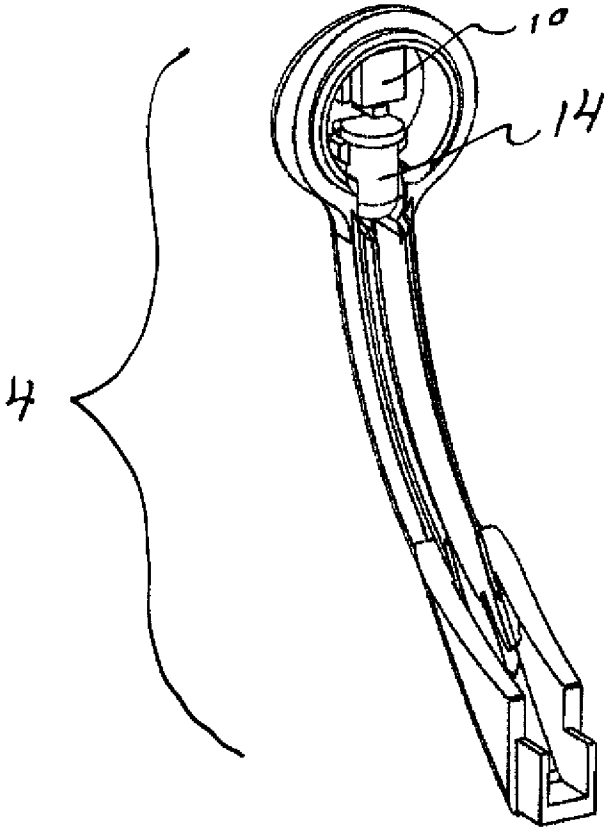
FIG. 6 is a perspective view of a curved cover panel.

FIG. 6 is a perspective view of a single curved cover plate 4. Photo diode 10 and LED 14 can be clearly seen.

Figure 7:
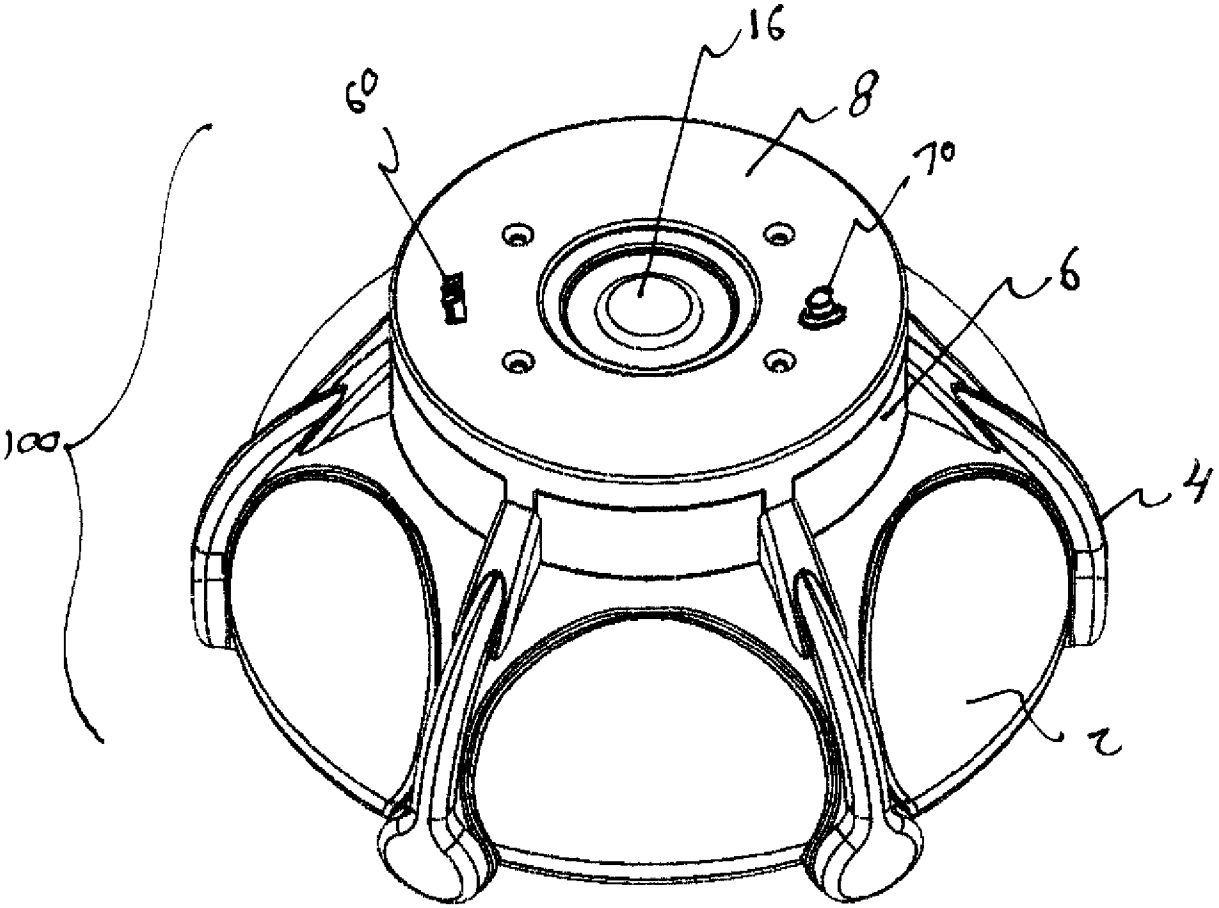
FIG. 7 is a bottom perspective view of the invention.

FIG. 7 is a perspective view showing the underside of the invention 100. An on off switch 60 can turn the electronics portion on. The push button 70 is used to record custom messages or melodies. Speaker 16 produces the sound that can be heard as the child eats his or her food.

Figure 8:
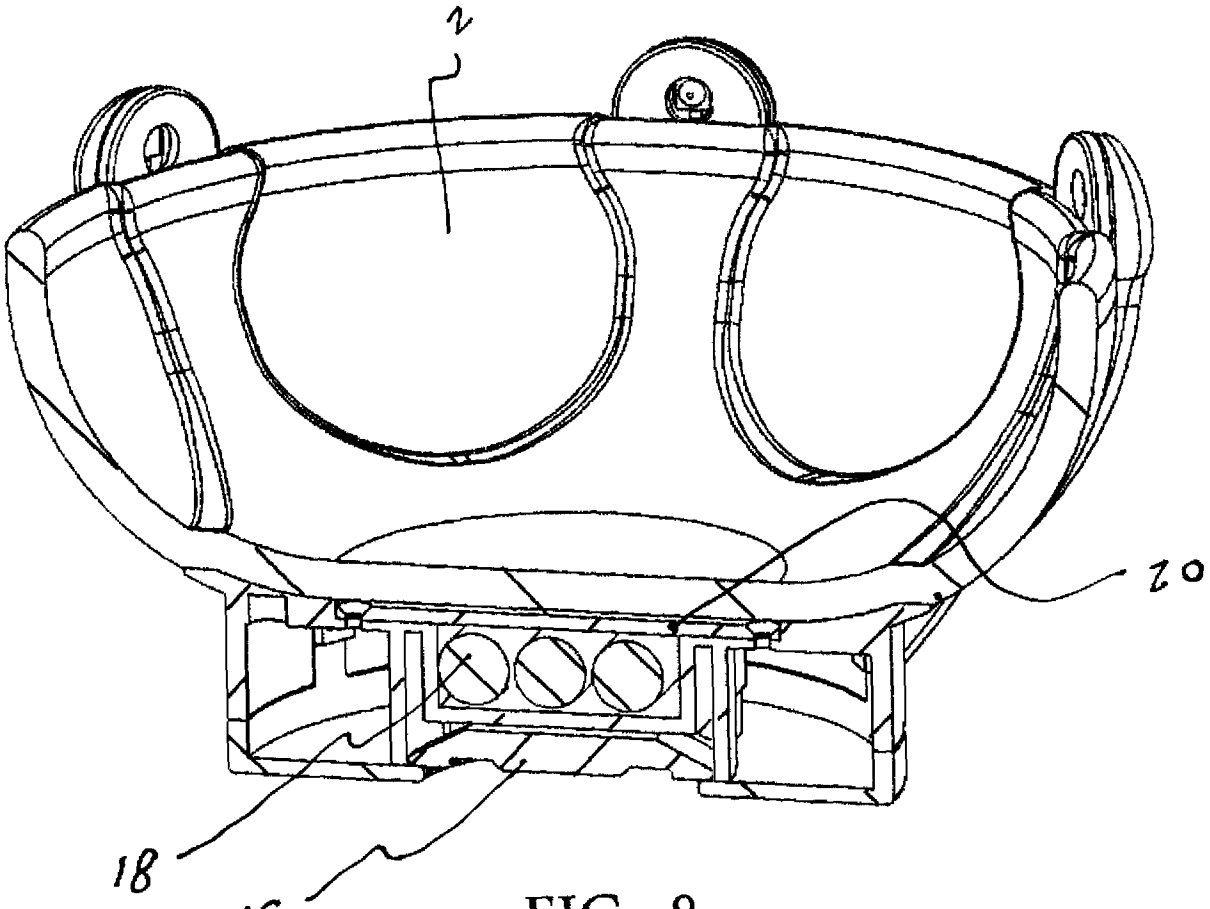
FIG. 8 is a section view bisecting the battery compartment.

FIG. 8 is a section view of the invention that shows the battery compartment and batteries 18 that power the electronics portion of the invention. Removable top panel 20 allows the user to replace the batteries 18.

Figure 9:
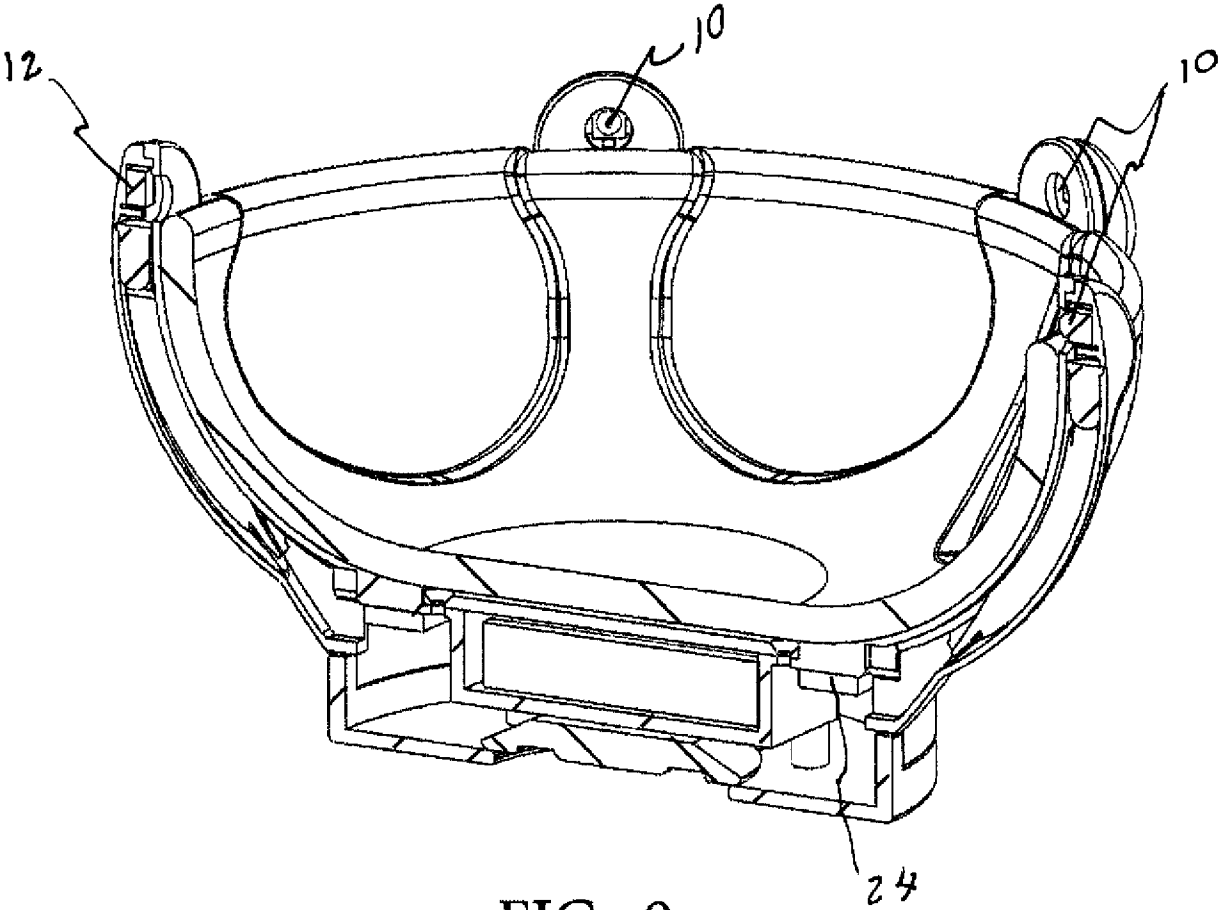
FIG. 9 is a section view bisecting the curved cover panels.

FIG. 9 is a section view of the invention showing diode 10 as it is aimed at photo sensor 12. The same configuration holds for the remaining photo diodes 10 and photo sensors 12 in the bowl retaining assembly 50. Printed Circuit board 24 holds the audio circuit and digital memory necessary to record and play back a message or melody. Both the audio circuit and digital memory are standard and well known in the industry and therefore are not described in detail.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Talking bowl comprising:

a bowl capable of holding liquid or solid food;

a bowl retaining assembly;

a plurality of curved cover panels;

an audio circuit;

a speaker;

a battery power supply;

a PC board;

a plurality of LEDs;

a plurality of photo diodes;

a plurality of photo sensors;

an on off switch;

a record switch;

said bowl capable of nesting inside of said bowl retaining assembly;

said bowl retaining assembly including a plurality of receiving sockets for said curved cover panels;

said curved cover panels each retaining one set electrically conductive wires terminating in and LED and one set of wires terminating in either a photo diode or a photo sensor;

said photo diodes each directing a beam of light to a photo sensor located directly across from said photo diode;

said PC board, said speaker, said battery power supply and said audio circuit mounted within a cavity at the base of said bowl retaining assembly;

said bowl retaining assembly including a base plate;

said bowl retaining assembly also including a removable upper panel for access to said battery power supply;

said record switch and said on-off switch mounted to the said bowl retaining base plate;

said audio circuit including a memory chip that can store a plurality of audio messages or melodies;

so that when a user dips his or her spoon into said bowl, said spoon interrupts the plane of light projected by said photo diodes thereby triggering one of the recorded messages or memories to be played by said audio circuit and said speaker; and said LEDs automatically illuminating as said message or melody is being played.

2. Talking bowl as claimed in claim 1 wherein said bowl is made of food grade molded plastic.

3. Talking bowl as claimed in claim 1 wherein said bowl is removably replicable from said bowl retaining assembly allowing said bowl to be washed independent of said bowl retaining assembly.

* * * * *